US011583725B1

(12) United States Patent
Choobin

(10) Patent No.: US 11,583,725 B1
(45) Date of Patent: Feb. 21, 2023

(54) EXERCISE AID FOR A TREADMILL

(71) Applicant: Ahmad Choobin, Springfield, VA (US)

(72) Inventor: Ahmad Choobin, Springfield, VA (US)

( * ) Notice: Subject to any disclaimer, the term of this patent is extended or adjusted under 35 U.S.C. 154(b) by 0 days.

(21) Appl. No.: 17/701,031

(22) Filed: Mar. 22, 2022

Related U.S. Application Data

(60) Provisional application No. 63/155,077, filed on Mar. 1, 2021.

(51) Int. Cl.
*A63B 22/00* (2006.01)
*A63B 21/00* (2006.01)
*A63B 22/02* (2006.01)

(52) U.S. Cl.
CPC ..... *A63B 22/0046* (2013.01); *A63B 21/4035* (2015.10); *A63B 22/02* (2013.01); *A63B 2208/0233* (2013.01)

(58) Field of Classification Search
CPC ..... A47C 9/002; A61H 3/00; A63B 21/16; A63B 21/1609; A63B 21/4027; A63B 21/4029; A63B 21/4033; A63B 21/4035; A63B 21/4039; A63B 22/0015; A63B 22/0017; A63B 22/0046; A63B 22/02; A63B 26/00; A63B 26/003; A63B 69/0028; A63B 69/0057; A63B 69/0064; A63B 2069/0037; A63B 71/0009; A63B 71/0054; A63B 2071/0072; A63B 2208/0228; A63B 2208/0233
See application file for complete search history.

(56) References Cited

U.S. PATENT DOCUMENTS 3,193,287 A * 7/1965 Robinson ..... A63B 22/02 482/54
3,826,491 A * 7/1974 Elder ..... A63B 22/0023 482/7
3,870,297 A * 3/1975 Elder ..... A63B 22/025 482/7
4,743,008 A * 5/1988 Fermaglich ..... A63B 69/0064 297/137
5,176,597 A * 1/1993 Bryne ..... A61H 3/008 482/54
5,411,279 A * 5/1995 Magid ..... B62B 7/12 280/87.051

(Continued)

FOREIGN PATENT DOCUMENTS

CN 109621298 A * 4/2019 ..... A61B 5/1038
CN 111111096 A * 5/2020 ..... A63B 22/0235

(Continued)

*Primary Examiner* — Gary D Urbiel Goldner
(74) *Attorney, Agent, or Firm* — Barry Choobin; Patent 360

(57) ABSTRACT

An apparatus and method of use thereof for exercising on a treadmill, the apparatus includes a frame that mounts to handles of the treadmill. The frame is an arch shape having a proximal bar, a distal bar opposite the proximal bar, and a curved portion extending between adjacent ends of the proximal bar and the distal bar. The proximal bar is coupled to the handles. A protective cushioned seat extends between the proximal bar and the distal bar. To use the apparatus, an individual can unhook a proximal end of the seat from the proximal bar, position the seat behind the buttocks and between the legs, reengage the proximal end of the seat to the proximal bar, and can then walk or run on the treadmill.

16 Claims, 4 Drawing Sheets

(56) References Cited

U.S. PATENT DOCUMENTS

| | | | | | |
|---|---|---|---|---|---|
| 5,437,588 | A * | 8/1995 | Abboudi | A63B 22/02 | 482/54 |
| 7,892,150 | B1 * | 2/2011 | Colley | A63B 22/0235 | 482/54 |
| 8,968,163 | B1 * | 3/2015 | Vidmar | A61H 3/008 | 482/54 |
| 9,498,696 | B1 * | 11/2016 | Razon | A63B 22/0046 | |
| 10,376,734 | B1 * | 8/2019 | Razon | A61B 5/0077 | |
| 2012/0264573 | A1 * | 10/2012 | Hsu | A63B 22/0235 | 482/54 |
| 2013/0116092 | A1 * | 5/2013 | Martinez | A63B 24/0062 | 482/9 |
| 2014/0100085 | A1 * | 4/2014 | Hao | A63B 22/0015 | 482/54 |
| 2017/0050079 | A1 * | 2/2017 | Kuo | G16H 20/30 | |
| 2021/0046354 | A1 * | 2/2021 | Oaks | A47B 83/001 | |
| 2021/0346754 | A1 * | 11/2021 | Brunner | A63B 24/0087 | |

FOREIGN PATENT DOCUMENTS

| | | | | | |
|---|---|---|---|---|---|
| CN | 112138330 | A * | 12/2020 | A63B 22/02 | |
| CN | 112206471 | A * | 1/2021 | A63B 22/02 | |
| DE | 202015101590 | U1 * | 11/2015 | A61B 5/1038 | |
| DE | 202015102320 | U1 * | 12/2015 | A61B 5/1107 | |
| EP | 0002188 | A1 * | 6/1979 | A63B 69/0057 | |
| KR | 20170058696 | A * | 5/2017 | A63B 22/02 | |
| KR | 20220127650 | A * | 9/2022 | A63B 22/025 | |
| TW | 200824751 | A * | 6/2008 | A63B 22/0235 | |
| WO | WO-8800850 | A1 * | 2/1988 | A63B 22/02 | |
| WO | WO-2004110566 | A1 * | 12/2004 | A63B 22/02 | |
| WO | WO-2018229500 | A1 * | 12/2018 | A61H 3/00 | |

* cited by examiner

EXERCISE AID FOR A TREADMILL

CROSS-REFERENCE TO RELATED APPLICATIONS

This application claims priority to the U.S. provisional patent application Ser. No. 63/155,077, filed on Mar. 1, 2021, which is incorporated herein by reference in its entirety.

FIELD OF INVENTION

The present invention relates to an exercise aid for a treadmill, and more particularly, the present invention relates to an exercise aid that allows obese people and people with weakness due to medical conditions to exercise on a treadmill.

BACKGROUND

A treadmill is well-known exercise equipment that is used for walking and running exercises. A treadmill is a compact device that requires lesser floor area and is a quite popular exercise equipment in gyms, offices, and residential buildings. A typical treadmill has a wide conveyor belt driven by a motor. An individual can step on the conveyor belt and can walk or run on the treadmill in an upright bodily position.

Like normal walking or running, the majority of the body weight of a person exercising on a treadmill is on the legs. Overweight people often find it difficult to walk or run because of being overweight. Similarly, people with weakness due to medical condition finds it difficult to walk or run. Using the treadmill to exercise is also not an option for overweight people as all the weight still falls on the legs. Also, it may not be recommended for overweight people to use the treadmill as this may negatively affect the joints.

Apparatuses are available that can suspend an individual in an upright position reducing the weight on the legs while walking or running. Such known apparatuses are however complex to use and require the aid of a coach and the like. Moreover, the known apparatuses are complex in construction, bulky, and costly.

Thus, a need is appreciated for an apparatus that allows overweight people or medically weak patients to exercise on the treadmill that is devoid of the aforesaid drawbacks of the known suspending apparatuses.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an apparatus that can aid exercising on a treadmill.

It is another object of the present invention that the apparatus can easily and quickly be installed and uninstalled from a treadmill.

It is still another object of the present invention that the apparatus is compact for storage and transport.

It is yet another object of the present invention that the apparatus is economical to manufacture.

It is a further object of the present invention that the apparatus can be used without help from a second person.

It is still a further object of the present invention that the effective weight of a person on legs can be controlled.

In one aspect, disclosed is an apparatus to aid in exercising using a treadmill, the apparatus comprising a pair of clamps configured to mount to a pair of handles of the treadmill; an upstanding leg coupled to the pair of clamps; a frame slidably mounted to the upstanding leg, the frame has a proximal bar and a distal bar, the proximal bar and the distal bar are spaced apart from each other and are substantially parallel to each other, the proximal bar is coupled to the upstanding leg; and a seat that has a proximal end and a distal end, the proximal end of the seat configured to mount to the proximal bar, the distal end of the seat configured to mount to the distal bar.

In one implementation, the apparatus further includes a first bar that extends between the pair of clamps; and an L-shape angle bar that includes the upstanding leg and a short leg, the short leg is coupled to the first bar. The frame further includes a sleeve coupled to the proximal bar, the sleeve configured to slidably mount to the upstanding leg, wherein the apparatus further includes a restriction member coupled to the sleeve, the restriction member configured to limit movement of the sleeve relative to the upstanding leg.

In one implementation, each of the proximal bar and the distal bar comprises a plurality of spaced apart hooks, wherein the proximal end of the seat has at least one proximal strap, the distal end of the seat has at least one distal strap, the at least one proximal strap configured to engage with at least one hook of the plurality of spaced apart hooks of the proximal bar, the at least one distal strap configured to engage with at least one hook of the of plurality spaced apart hooks of the distal bar. The at least one proximal strap includes three proximal straps and the at least one distal strap comprises three distal straps. The at least one proximal strap has a plurality of spaced apart apertures and the at least one distal strap has a plurality of spaced apart apertures.

In one implementation, the seat is made of semi-rigid to flexible material. The frame further includes an arch bar that extends between adjacent ends of the proximal bar and the distal bar. Suitable cushioning can also be provided.

In one aspect, disclosed is a method for exercising on a treadmill, the method comprising the steps of providing an apparatus comprising a pair of clamps configured to mount to a pair of handles of the treadmill; an upstanding leg coupled to the pair of clamps, a frame slidably mounted to the upstanding leg, the frame has a proximal bar and a distal bar, the proximal bar and the distal bar are spaced apart from each other and are substantially parallel to each other, the proximal bar is coupled to the upstanding leg, and a seat that has a proximal end and a distal end, the proximal end of the seat configured to mount to the proximal bar, the distal end of the seat configured to mount to the distal bar; disengaging the proximal end of the seat from the proximal bar; positioning the seat behind buttocks and between legs of an individual; and mounting the proximal end of the seat to the proximal bar.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
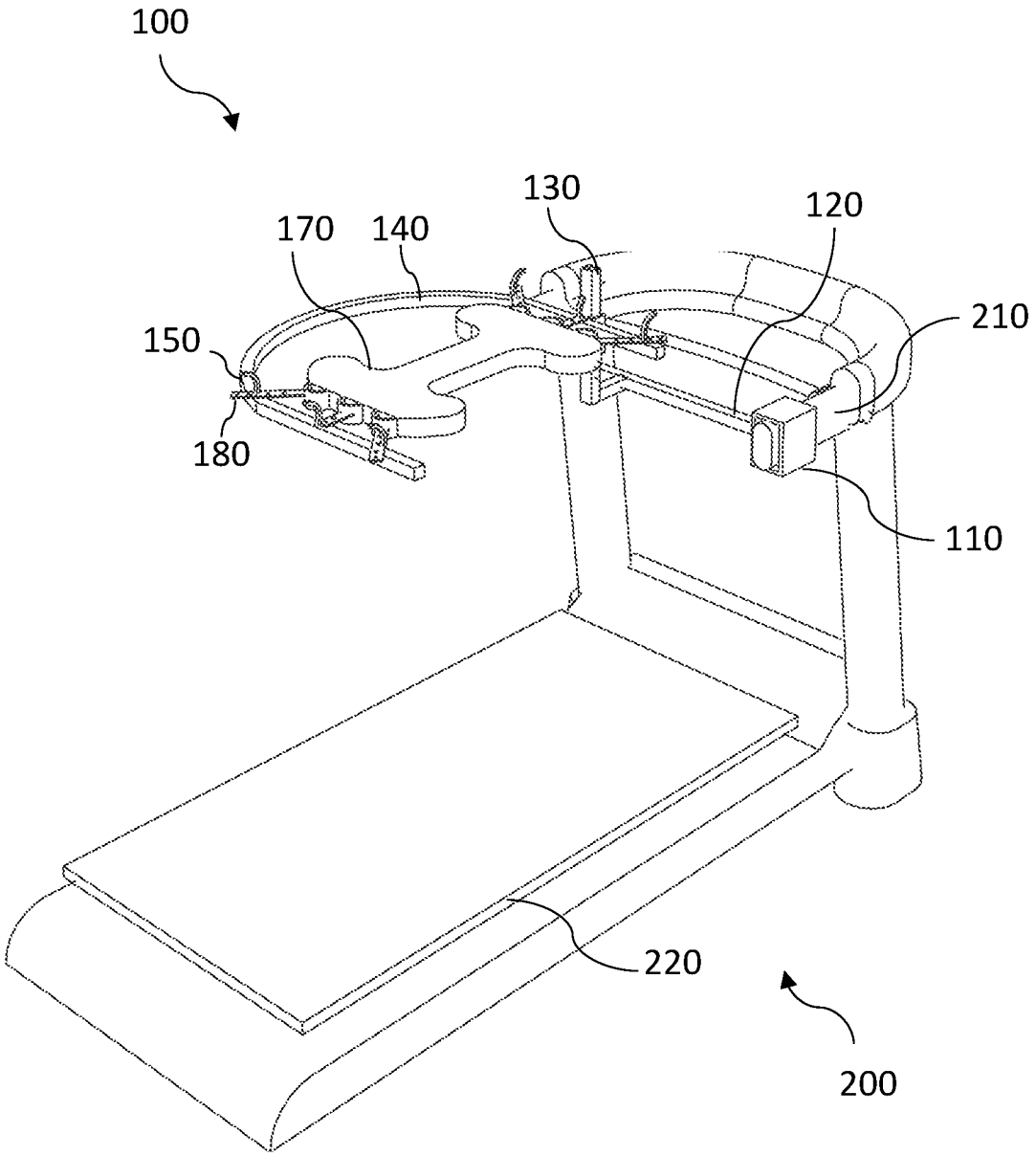
FIG. 1 is a perspective view of the apparatus shown mounted to handles of a treadmill, according to an exemplary embodiment of the present invention.

Referring to FIG. 1 which shows the disclosed apparatus 100 mounted to a treadmill 200. The disclosed apparatus can be used to suspend a person in a partially sitting position such that only a portion of the body weight falls on the legs. Moreover, the bodyweight on the legs can be adjusted by increasing or decreasing the height of the apparatus from the conveyor belt of the treadmill. The treadmill 200 can be any conventional treadmill having handles 210 that can be grabbed by a person while exercising for support.

Figure 2:
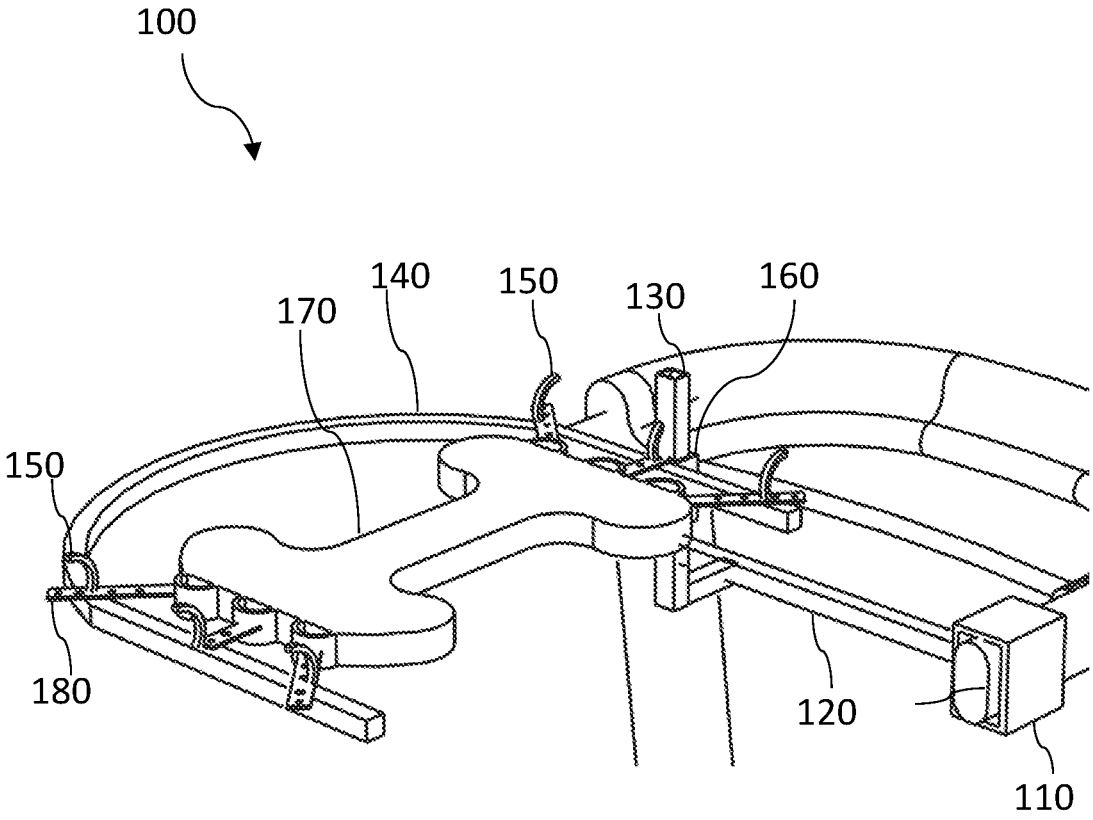
FIG. 2 is an enlarged view of the apparatus shown in FIG. 1, according to an exemplary embodiment of the present invention.
Figure 3:
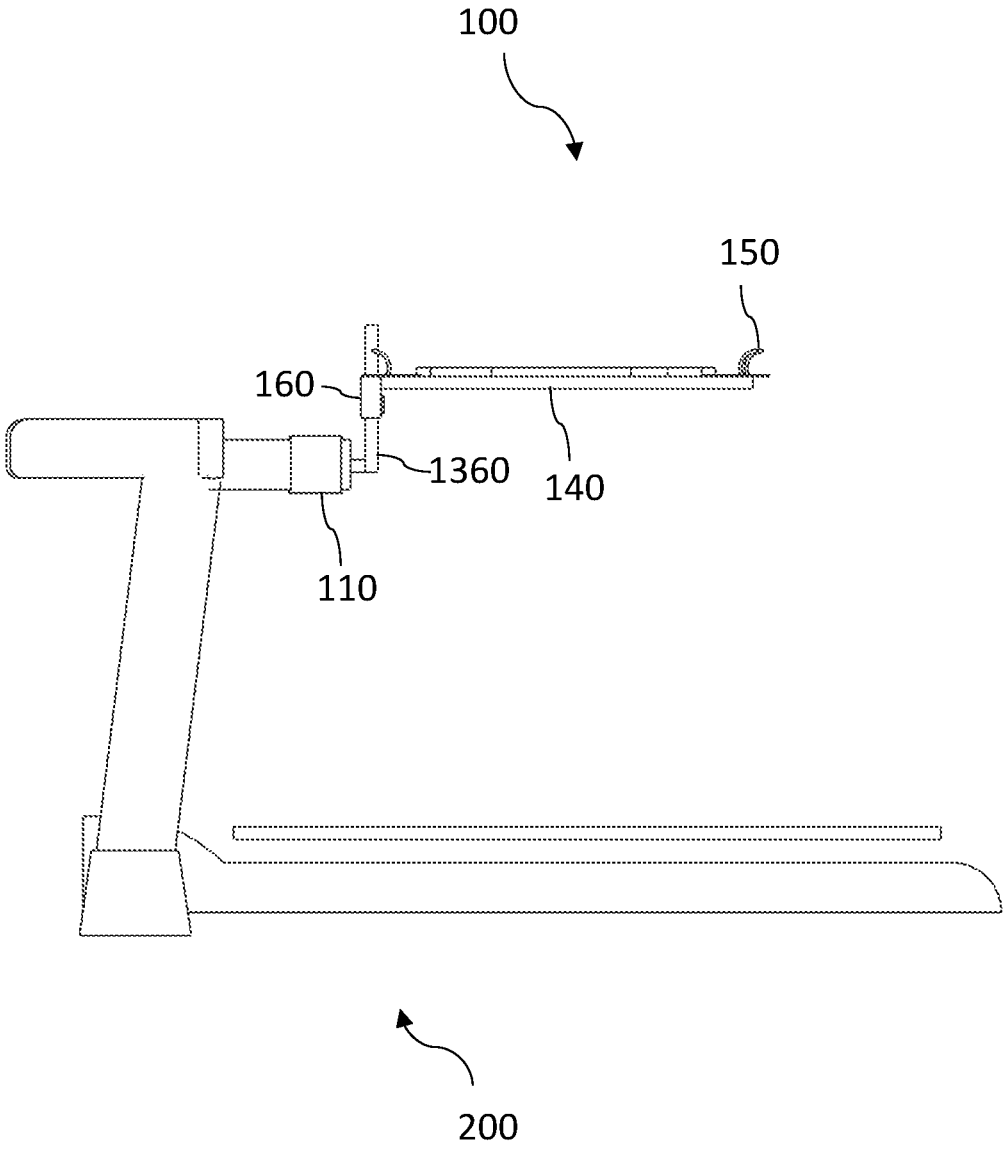
FIG. 3 is a side view of the apparatus and the treadmill as shown in FIG. 1, according to an exemplary embodiment of the present invention.
Figure 4:
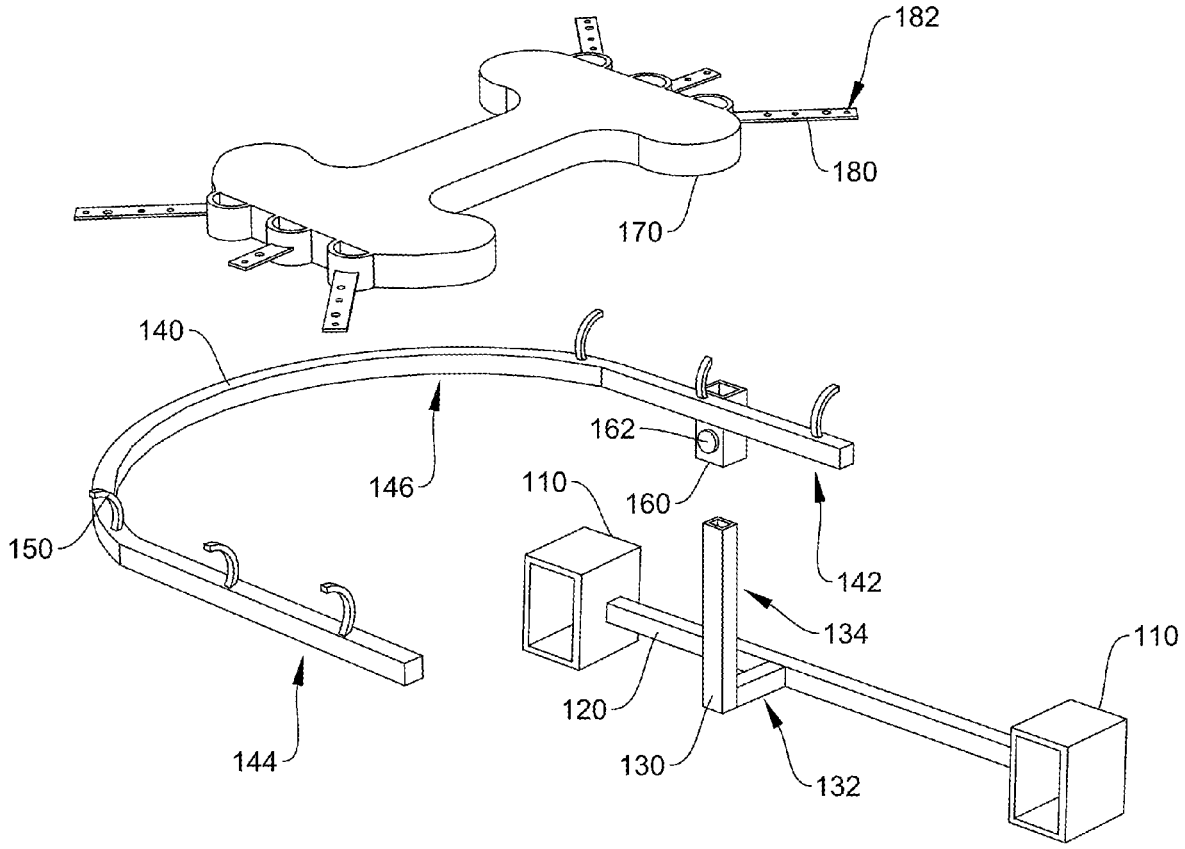
FIG. 4 is an exploded view of the apparatus, according to an exemplary embodiment of the present invention.

The disclosed apparatus 100 includes two clamps 110 that can mount to the two handles 210 of the treadmill 200. The two clamps can mount to the two handles and can be of any shape including square, U-shape, or L shape. FIGS. 1 and 2 show the clamps as square shape sleeves that can slide over the two handles. The clamps can be made from strong and durable materials, such as iron. The two clamps 110 can be coupled at two ends of a first bar 120. The length of the first bar 120 can be proportional to the distance between the two handles 210 of the treadmill 200. The length of the first bar may allow mounting the two clamps to the two handles of the treadmill. In one exemplary embodiment, the length of the first bar 120 can be varied using an extension means that allows increasing and decreasing the length of the first bar 120. For example, the first bar can be provided in two parts coupled by the extension means, which allows moving the two parts away from each other and towards each other.

The disclosed apparatus further includes an L-shape angle bar 130 having a short leg 132 and a long leg 134, the short leg 132 of the angle bar 130 can be coupled to the first bar 120, preferably at a midpoint of the first bar 120. While FIG. 1 shows a single angle bar 130, however, more than one angle bars are within the scope of the present invention. Moreover, the angle bar 130 can have multiple short legs that attach to different points on the first bar 120. The long leg 134 of the angle bar 130 can extend upwards and/or downwards.

Preferable, the long leg 134 of the angle bar 1360 can extend perpendicular to an imaginary horizontal plane. The long leg 134 of the angle bar 130 can allow adjusting a height of a seat of the apparatus 100 from the conveyor belt 220. The apparatus 100 further includes a frame 140 that can be of an arch shape having a proximal end and a distal end. Frame 140 can include a proximal bar 142 at the proximal end, a distal bar 144 at the distal end, the proximal bar can be substantially parallel to the distal bar, and a curved portion 146 extends between ends of the proximal bar and the distal bar to form an arch shape frame 140. To the proximal bar 142 and the distal bar 144 can be coupled several hooks 150 at spaced intervals. FIG. 2 shows a total of six hooks, three hooks on each of the proximal bar and the distal bar. A sleeve 160 can be coupled to the proximal bar 142 that allows mounting the frame 140 to the long leg 134 of the angle bar 130. The sleeve 160 can slide up and down on the long leg 134 of the angle bar 130. Suitable restriction member 162, such as a height adjustable knob can also be provided coupled to the sleeve 160 that allows restricting the sleeve 160 at the desired position on the long leg 134 of the angle bar 130. For example, the long leg 134 can have threaded apertures and the restriction member 162 can be a threaded fastener that passes through the holes in the sleeve 160 and the threaded apertures in the long leg 134 of the angle bar 130. Alternative pass-through holes can be provided in the long leg 134 (upstanding leg) and the sleeve 160, and a fastener can restrict the movement of the sleeve over the long leg. The long bar can include spaced-apart holes at regular intervals, and the height of the sleeve can be adjusted relative to the long bar. While FIG. shows the arch-shaped frame, however, it is obvious to a skilled person that the frame can be of any other shape such as three perpendicular bars.

The apparatus further comprises a seat 170 that can be mounted to frame 140. The seat can have suitable cushioning. The seat can include a proximal end and a distal end. Several straps 180 can be provided extending outwards from the proximal end and the distal end of the seat 170, the several straps are spaced apart from each other, for example, at regular intervals. The number of straps 180 can be proportional to the number of the hooks 150 in the frame, however, the number of straps 180 can be different from the number of hooks 150. Each strap can include spaced-apart apertures 182 and through one aperture of the spaced-apart apertures in each strap, the each strap can be hooked to the relative hook of the frame. The straps on both sides of the seat can couple to the hooks 150 on the proximal bar 142 and the distal bar 144 of the frame. The seat 170 extends between the proximal bar 142 and the distal bar 144 of the frame 140. The seat 170 can be made from a rigid or flexible material, and the slack in the seat can be adjusted by engaging the straps at different points. Also, it is understood that the apertures in the straps and hooks can be substituted by any other suitable fastening mechanism without departing from the scope of the present invention. The straps can be elastic power band.

To use the apparatus, an individual can mount the apparatus to the handles of the treadmill. The apparatus can be assembled first and then mounted to the treadmill. Alternatively, the clamps and frame can be mounted first to the treadmill, and thereafter, the seat can be mounted to the frame. The proximal end of the seat can be disengaged from the frame and the seat can be positioned between two legs of the individual, and then the seat can be put behind the buttocks. The proximal end of the seat can then be fastened to the frame and the individual can somewhat sit on the seat putting his body weight on the seat. The legs can be in touch with the conveyor belt. The majority of the bodyweight of the individual can be on the seat and the individual can easily walk or run on the treadmill without undue force or pressure on the legs or joints. The seat can be raised to put more weight on the seat. Similarly, the seat can be lowered to put more weight on the legs.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An apparatus to aid in exercising using a treadmill, the apparatus comprising:

a pair of clamps configured to mount to a pair of handles of the treadmill;

an upstanding leg coupled to the pair of clamps;

a frame slidably mounted to the upstanding leg, the frame having a proximal bar and a distal bar, the proximal bar and the distal bar being spaced apart from each other and being substantially parallel to each other, the proximal bar coupled to the upstanding leg; and a seat having a proximal end and a distal end, the proximal end of the seat configured to mount to the proximal bar, the distal end of the seat configured to mount to the distal bar.

2. The apparatus according to claim 1, wherein the apparatus further comprises:

a first bar extending between the pair of clamps; and an L-shaped angle bar comprising the upstanding leg and a short leg, the short leg coupled to the first bar.

3. The apparatus according to claim 2, wherein the frame further comprises a sleeve coupled to the proximal bar, the sleeve configured to slidably mount to the upstanding leg, wherein the apparatus further comprises a restriction member coupled to the sleeve, the restriction member configured to limit movement of the sleeve relative to the upstanding leg.

4. The apparatus according to claim 1, wherein each of the proximal bar and the distal bar comprises a plurality of spaced apart hooks, wherein the proximal end of the seat has at least one proximal strap, the distal end of the seat has at least one distal strap, the at least one proximal strap configured to engage with at least one hook of the plurality of spaced apart hooks of the proximal bar, and the at least one distal strap configured to engage with at least one hook of the plurality of spaced apart hooks of the distal bar.

5. The apparatus according to claim 4, wherein the at least one proximal strap comprises three proximal straps and the at least one distal strap comprises three distal straps.

6. The apparatus according to claim 4, wherein the at least one proximal strap has a plurality of spaced apart apertures and the at least one distal strap has a plurality of spaced apart apertures.

7. The apparatus according to claim 1, wherein the seat is made of semi-rigid to flexible material.

8. The apparatus according to claim 1, wherein the frame further comprises an arch-shaped bar extending between adjacent ends of the proximal bar and the distal bar, respectively.

9. A method for exercising on a treadmill, the method comprising the steps of:

providing an apparatus comprising:

a pair of clamps configured to mount to a pair of handles of the treadmill;

an upstanding leg coupled to the pair of clamps;

a frame slidably mounted to the upstanding leg, the frame having a proximal bar and a distal bar, the proximal bar and the distal bar being spaced apart from each other and being substantially parallel to each other, the proximal bar coupled to the upstanding leg; and a seat having a proximal end and a distal end, the proximal end of the seat configured to mount to the proximal bar, the distal end of the seat configured to mount to the distal bar;

disengaging the proximal end of the seat from the proximal bar;

positioning the seat behind buttocks and between legs of an individual; and mounting the proximal end of the seat to the proximal bar.

10. The method according to claim 9, wherein the apparatus further comprises:

a first bar extending between the pair of clamps; and an L-shaped angle bar comprising the upstanding leg and a short leg, the short leg coupled to the first bar.

11. The method according to claim 10, wherein the frame further comprises a sleeve coupled to the proximal bar, the sleeve configured to slidably mount to the upstanding leg, wherein the apparatus further comprises a restriction member coupled to the sleeve, the restriction member configured to limit movement of the sleeve relative to the upstanding leg, wherein the method further comprises the steps of:

raising or lowering the frame relative to the upstanding leg.

12. The method according to claim 9, wherein each of the proximal bar and the distal bar comprises a plurality of spaced apart hooks, wherein the proximal end of the seat has at least one proximal strap, the distal end of the seat has at least one distal strap, the at least one proximal strap configured to engage with at least one hook of the plurality of spaced apart hooks of the proximal bar, and the at least one distal strap configured to engage with at least one hook of the plurality of spaced apart hooks of the distal bar.

13. The method according to claim 12, wherein the at least one proximal strap comprises three proximal straps and the at least one distal strap comprises three distal straps.

14. The method according to claim 13, wherein the at least one proximal strap has a plurality of spaced apart apertures and the at least one distal strap has a plurality of spaced apart apertures.

15. The method according to claim 9, wherein the seat is made of semi-rigid to flexible material.

16. The method according to claim 9, wherein the frame further comprises an arch-shaped bar extending between adjacent ends of the proximal bar and the distal bar, respectively.

* * * * *